US008179212B2

(12) United States Patent
Seo et al.

(10) Patent No.: US 8,179,212 B2
(45) Date of Patent: May 15, 2012

(54) FREQUENCY TUNABLE FILTER

(75) Inventors: Jae Ok Seo, Bucheon (KR); Suk Woo Lee, Bucheon (KR); Dong Wan Chun, Incheon (KR); Jin Yang Kim, Incheon (KR); Kwang Sun Park, Incheon (KR)

(73) Assignee: Ace Technologies Corporation, Incheon (KR)

( * ) Notice: Subject to any disclaimer, the term of this patent is extended or adjusted under 35 U.S.C. 154(b) by 663 days.

(21) Appl. No.: 12/182,448

(22) Filed: Jul. 30, 2008

(65) Prior Publication Data

US 2009/0058563 A1 Mar. 5, 2009

(30) Foreign Application Priority Data

Aug. 28, 2007 (KR) ..... 10-2007-0086585
Aug. 28, 2007 (KR) ..... 10-2007-0086586
Aug. 28, 2007 (KR) ..... 10-2007-0086587

(51) Int. Cl.
*H01P 1/202* (2006.01)
*H01P 7/06* (2006.01)

(52) U.S. Cl. ..... 333/203; 333/207

(58) Field of Classification Search ..... 333/202–212, 333/227, 230–233, 235
See application file for complete search history.

(56) References Cited

U.S. PATENT DOCUMENTS

| | | | | |
|---|---|---|---|---|
| 4,100,504 | A * | 7/1978 | McGann | 331/39 |
| 6,717,490 | B1 * | 4/2004 | Mayer | 333/202 |
| 7,005,951 | B2 * | 2/2006 | Motooka et al. | 333/235 |
| 7,449,981 | B2 * | 11/2008 | Park et al. | 333/203 |
| 7,825,753 | B2 | 11/2010 | Park et al. | |
| 2004/0041661 | A1 * | 3/2004 | Yamakawa et al. | 333/134 |
| 2005/0212623 | A1 | 9/2005 | Ala-Kojola | |

FOREIGN PATENT DOCUMENTS

KR 20-0307592 3/2003

* cited by examiner

*Primary Examiner* — Benny Lee
*Assistant Examiner* — Gerald Stevens
(74) *Attorney, Agent, or Firm* — Edwards Wildman Palmer LLP

(57) ABSTRACT

A frequency tunable filter comprises a housing having a plurality of walls therein defining a plurality of cavities; a cover mounted on the housing; a plurality of resonators contained in the cavities; at least one sliding member located between the cover and the resonators; and a plurality of metal tuning elements attached to a lower part of the sliding member, wherein frequency tuning is performed by sliding of the sliding member.

7 Claims, 15 Drawing Sheets

FREQUENCY TUNABLE FILTER

CROSS-REFERENCE TO RELATED APPLICATION

This application claims under 35 U.S.C. §119(a) the benefit of Korean Patent Application Nos. 10-2007-0086585, 10-2007-0086586 and 10-2007-0086587 filed Aug. 28, 2007, the entire contents of which are incorporated herein by reference.

TECHNICAL FIELD

The present invention relates to a tunable filter that can change characteristics of the filter including center frequency and bandwidth.

BACKGROUND ART

A filter is a device designed to pass a predetermined frequency band from an inputted RF signal. The filter has been realized in various ways. In case of an RF filter, a pass band is determined by inductance and capacitance of the filter. Tuning refers to adjusting a pass band of the filter.

In a communication system such as a mobile communication system, a plurality of pass bands are allotted to communication service providers. Generally, the service providers divide the allotted pass bands into a plurality of channels. They use a filter corresponding to allotted frequency bands.

Recently, rapid change and development of communication systems call for varying the characteristics of a filter such as center frequency and bandwidth. To meet the demand, a tunable filter has been proposed.

FIG. 1 shows a conventional tunable filter. The conventional tunable filter comprises a housing 100, an input connector 102, an output connector 104, a cover 106, and a plurality of cavities 108 and a plurality of resonators 110.

A plurality of walls are formed inside the filter and a plurality of cavities 108 are defined by the walls. Each of the resonators 110 is contained in each of the cavities. There are coupling holes on the cover 106 for coupling the cover and the housing 100. Tuning bolts 112 are inserted into the housing 100 though the cover 106. The tuning bolts 112 are inserted at or near positions where resonators are located.

An RF signal is inputted to the input connector 102 and outputted from the output connector 104. The RF signal propagates through coupling windows formed in each cavity. Resonance of the RF signal is generated by each cavity 108 and resonator 110 and filtering is performed by the resonance. In the conventional tunable filter, tuning for frequency and bandwidth is performed using the tuning bolts.

FIG. 2 is a cross sectional view of a cavity of the conventional tunable filter. Referring to FIG. 2, the tuning bolt 112 inserted though the cover 106 lies over a upper part of the resonator. The tuning bolt 112 is made of metal material and fixed to the cover 106 by a nut. The distance between the resonator 110 and the tuning bolt 112 can be adjusted by rotating the tuning bolt 112, and filter tuning is performed by adjusting the distance. The rotation of the tuning bolt 112 can be performed manually or automatically using a tuning machine.

FIG. 3 shows tuning principle in which the conventional tunable filter is tuned. Referring to FIG. 3, capacitance is generated between the tuning bolt 112 and the resonator 110. Capacitance is determined by a dielectricity, a distance, and an area between the tuning bolt 112 and the resonator 110. Capacitance is one parameter that determines center frequency of a filter. The above-described conventional tunable filter, however, has following disadvantages. When tuning is performed manually, it takes a long time because each of the tuning bolts 112 has to be rotated. This becomes severe when there are many tuning bolts because each of the tuning bolts has to be rotated independently. As a result, labor and manufacturing costs increase. Also, after tuning is performed, it is hard to lock the location of the tuning bolts. In particular, each tuning bolt must be tightly locked when a distance between the tuning bolt and the resonator is set. Tuning bolts tend to micro-rotate in the locking process, which results in failure of tuning. In order to overcome this problem, other locking means is required. In addition, it is hard to obtain a wide tuning range on account of high power trouble.

For a wide tuning range, the distance between the tuning bolt and the resonator needs to be long enough. For smaller filters, obtaining a wide tuning range is more difficult.

The above information disclosed in this Background section is only for enhancement of understanding of the background of the invention and therefore it may contain information that does not form the prior art that is already known in this country to a person of ordinary skill in the art.

SUMMARY OF THE DISCLOSURE

Accordingly, the present invention has been made in an effort to solve the above-described problems associated with the prior art. One object of the present invention is to provide a frequency tunable filter with that can tune a plurality of resonators at one time.

Another object of the present invention is to provide a frequency tunable filter that can shorten tuning time and reduce manufacturing cost.

Still another object of the present invention is to a frequency tunable filter that can provide a wide tuning range.

In order to achieve above-mentioned objects, according to an aspect of the present invention, there is provided a frequency tunable filter, comprising: a housing having a plurality of walls defining a plurality of cavities; a cover mounted on the housing; a plurality of resonators contained in the cavities; at least one sliding member located between the cover and the resonators; and a plurality of metal tuning elements attached to a lower part of the sliding member, wherein frequency tuning is performed by sliding of the sliding member.

Preferably, the number of the metal tuning elements are the same as that of the resonators, and the metal tuning elements are attached to the lower part of the sliding member at or near the positions where the resonators are provided.

Also preferably, the filter may further comprise a plurality of tuning bolts inserted into the cover. In this case, holes may be formed on the sliding member for insertion of the tuning bolts and the holes may be so long as not to block the sliding of the sliding member.

Suitably, a plurality of ground members may be attached to an upper part of the sliding member.

Also suitably, the number of the ground members may be the same as that of the metal tuning elements, and the ground members may be electrically coupled to the metal tuning elements. In this case, the ground members each may be electrically coupled to each of the metal tuning elements through a bolt.

Preferably, at least one guide groove may be provided in a lower part of the cover for guiding sliding operation of the sliding member inserted in the guide groove.

Also preferably, a plurality of friction prevention grooves may be formed on a lower part of the cover beside the guide groove for preventing friction between the metal tuning elements and the cover.

Suitably, the filter may further comprise an operation part for providing operation power for sliding the sliding member, and coupling holes may be formed on the sliding member for coupling the sliding member with the operation part. In this case, preferably, the operation part may comprise: a motor; a screw for transforming rotational movement into horizontal movement; and a middle member coupled to the screw and the sliding member for sliding the sliding member by relaying the horizontal movement to the sliding member.

In another aspect, the present invention provides a frequency tunable filter, comprising: a cover; a plurality of resonators contained in a plurality of cavities; a sliding member located between the resonators and the cover; and a plurality of metal tuning elements attached to a lower part of the sliding member and associated with the plurality of the resonators, wherein frequency characteristic is varied by the interaction between the metal tuning elements and the resonators.

Preferably, a plurality of ground members may be attached to an upper part of the sliding member, the ground members being electrically coupled to the cover. In this case, suitably, the number of the ground members may be the same as that of the metal tuning elements, and the ground members may be electrically coupled to the metal tuning elements.

Also preferably, the sliding member may slide by operation power provided by an operation part inside or outside the filter, the operation part including a motor, a screw and a middle member coupled to the middle member.

Suitably, a guide groove may be formed on the cover for guiding sliding operation of the sliding member, and the sliding member may be inserted in the guide groove.

In still another aspect, the present invention provides a frequency tunable filter, comprising: a plurality of resonators contained in a plurality of cavities; at least one sliding member; a plurality of metal tuning elements attached to a lower part of the sliding member at a position over the resonators; and at least one ground member for providing ground voltage to the metal tuning elements.

Preferably, the ground member may be attached to an upper part of the sliding member. Here, the ground member may be electrically coupled to a cover of the filter. Further, the number of the metal tuning elements may be the same as that of the resonators and the number of the ground members may be the same as that of the metal tuning elements, and the ground member may be electrically coupled to the metal tuning element. In this case, the ground member may be coupled to the sliding member and the metal tuning element through a bolt.

Also preferably, the ground member may include wings having an elastic body for contacting a cover of the filter. In this case, the elastic body may include a leaf spring. Also, in this case, a guide groove may be formed on the cover for guiding siding of the sliding member, the sliding member may be inserted in the guide groove, and the wings may be electrically coupled to the guide groove. Further, width of wings may be designed to be narrow sufficient to minimize friction with the cover.

Suitably, a plurality of friction prevention grooves may be formed on a lower part of the cover beside the guide groove for preventing friction between the metal tuning elements and the cover.

In a further aspect, the present invention provides a frequency tunable filter, comprising: a plurality of resonators contained in a plurality of cavities; at least one sliding member; and a plurality of metal tuning elements attached to the sliding member at a position over the resonators, wherein slope is formed on at least one lower surface of the metal tuning elements, at least one upper surface of the resonators, or both.

Preferably, slope direction of the metal tuning element may be the same as that of the resonator.

Also preferably, slope direction of the metal tuning element may be opposite to that of the resonator.

Suitably, slope angle of some of the metal tuning elements may be different form that of the other metal tuning elements.

Also suitably, slope angle of some of the resonators may be different from that of the other resonators.

Preferably, slope shape of the resonator may be a truncated cone.

Also preferably, a plurality of ground members may be attached to an upper part of the sliding member for providing ground voltage to the metal tuning elements and the ground members may be electrically coupled to the metal tuning elements. In this case, the ground members may be in electrical contact with a cover of the filter.

The above and other aspects and features of the invention will be discussed infra.

DETAILED DESCRIPTION

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

Figure 1:
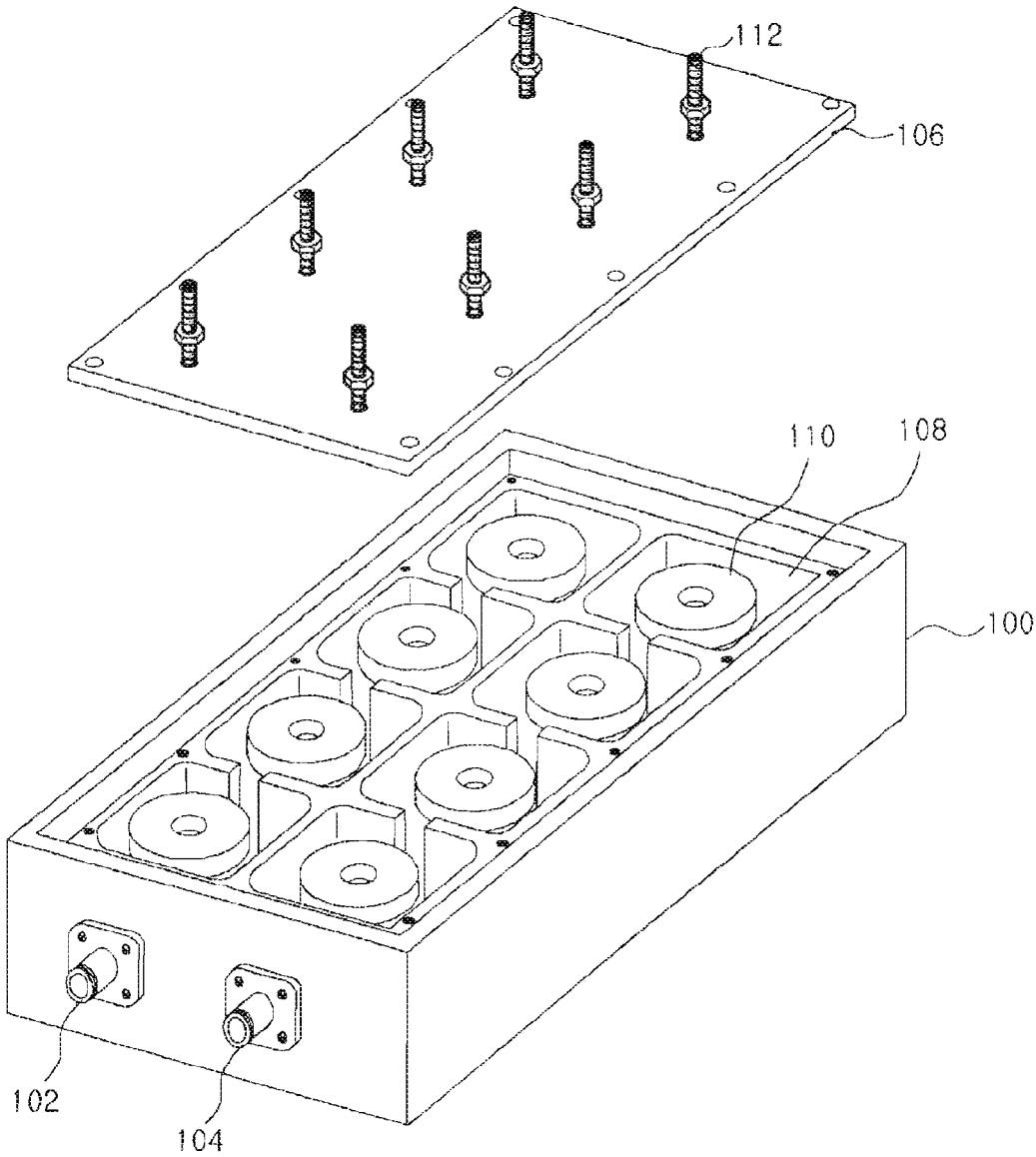
FIG. 1 (PRIOR ART)
FIG. 1 shows a conventional tunable filter.
Figure 2:
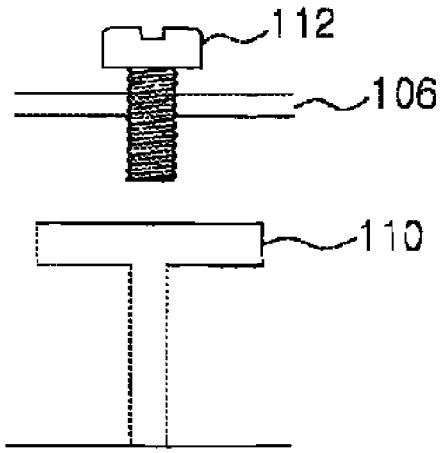
FIG. 2 (PRIOR ART)
FIG. 2 is a cross sectional view of a cavity of the tunable filter of FIG. 1.
Figure 3:
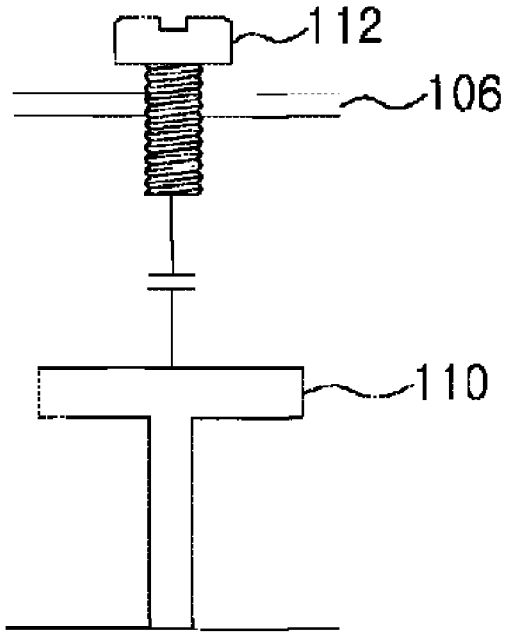
FIG. 3 (PRIOR ART)
FIG. 3 shows tuning principle in which the conventional tunable filter is tuned.
Figure 4:
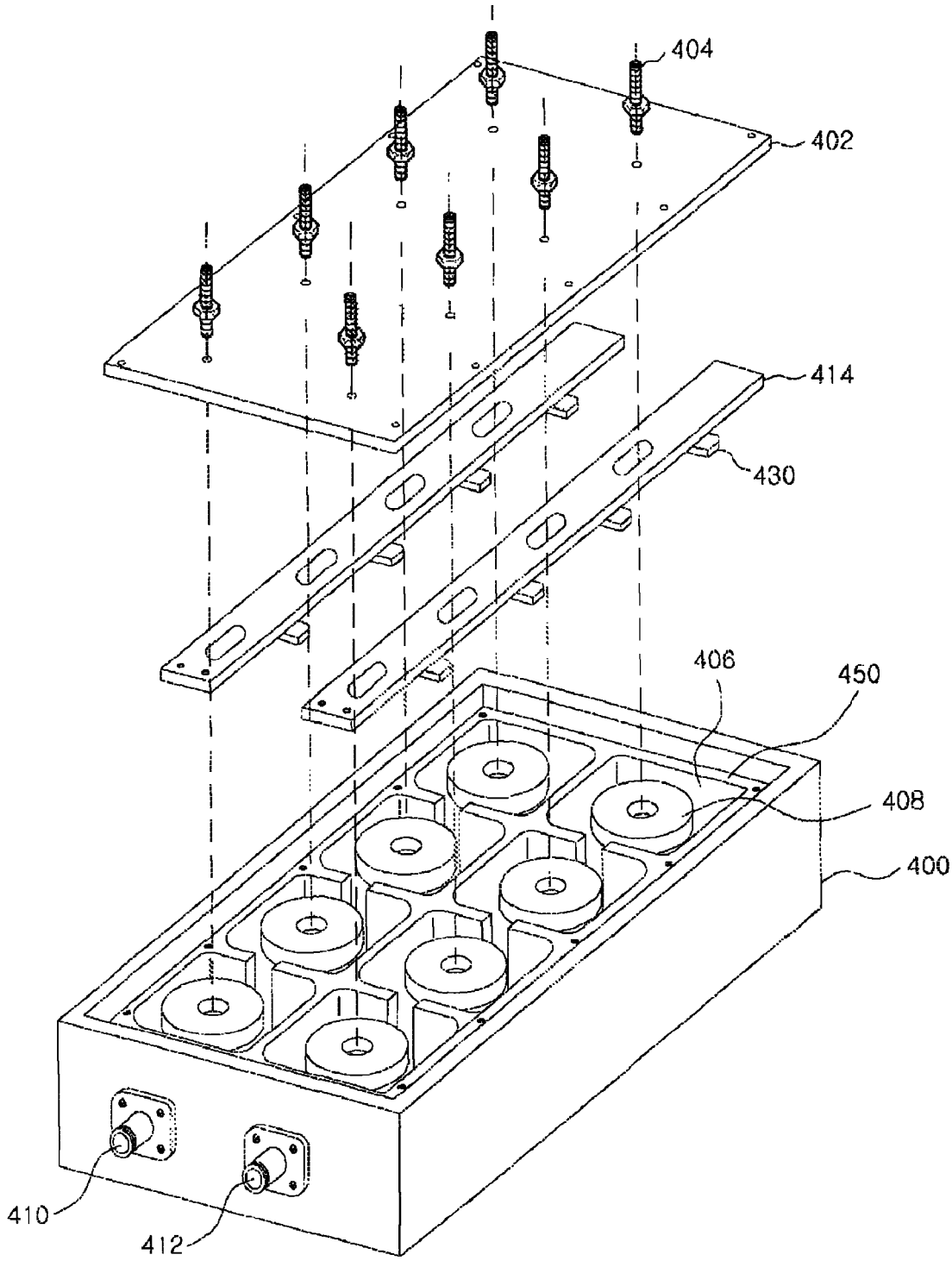
FIG. 4 is a disjointed perspective view of a frequency tunable filter according to a preferred embodiment of the present invention.

FIG. 4 is a disjointed perspective view of a frequency tunable filter according to a preferred embodiment of the present invention. The frequency tunable filter according to a preferred embodiment of the present invention may comprise a housing 400, a cover 402, a plurality of tuning bolts 404, a plurality of cavities 406, a plurality of resonators 408, an input connector 410, an output connector 412, sliding members 414 and metal tuning elements 430 attached to the sliding members 414.

The housing 400 protects inner components of the filter and operates as shield against electromagnetic wave. The housing 400 can be made of conducting material. Preferably, it can be made of metal such as, for example, aluminum or aluminum ally. To minimize loss, the housing 400 may be surface-treated by silver. Particularly, silver plating having good conductivity is preferred. Recently, other kinds of plating than silver plating are used for improving corrosion resistance, for example.

The cover 402 is mounted on the top of the housing 400. Bolts are used to mount the cover 402 on the housing, and there are a plurality of bolt holes (now shown) to mount the cover 402 on the housing 400 with bolts. Holes for tuning bolts 404 are also formed on the cover 402, and the tuning bolts 404 are inserted into the housing through the holes for tuning bolts 404. Screw thread is formed in the holes for the tuning bolts 404. The insertion depth of the tuning blots 404 can be adjusted by rotation of the tuning bolts 404.

Although FIG. 4 shows that the tuning bolts 404 are located over the center of the resonators 408, it is possible to locate the tuning bolts 404 at different locations. For example, the tuning bolts 404 can be a little shifted from the center of the resonators, as will be described below.

According to the present invention, tuning can be made by the sliding members 414, the tuning bolts, or both. For example, filter producers may use the tuning bolts in initial tuning and users may tune frequency by sliding members. A wider tuning range can be obtained when both of the tuning methods are used.

The filters in which tuning is made by the sliding member do not include the tuning bolts 404. In an embodiment, such filters may still include the tuning bolts.

The distance between the tuning bolts 404 and resonators 408 can be adjusted by rotation of the tuning bolts 404. The tuning bolts 404 may be rotated manually or by a tuning machine. The tuning bolts 404 are locked by nuts or other locking means when tuning is completed in order to maintain a fixed distance between the tuning bolts 404 and resonators 408.

A plurality of walls are formed in the filter and the walls define cavities along with the housing. Each of the cavities contains a resonator 408. The number of cavity and resonator is associated with number of poles and can be adjusted accordingly. The filter shown in FIG. 4 has 8 poles (i.e. 8 resonators). The number of poles is associated with insertion loss and skirt characteristic. That is, as the number of poles increases, the skirt characteristic improves while insertion loss increases. The number of poles is set according to required insertion loss and skirt characteristic.

Although disk type resonators are shown in FIG. 4, various types of resonators including cylinder type resonators also can be used.

At least one coupling window is formed in part of the walls in accordance with propagation direction of RF signal. RF signal propagates from one cavity to another cavity through the coupling window or windows.

At least one sliding member 414 is located between the cover 402 and the resonators 408, although FIG. 4 shows that the filter includes two sliding members 414. The sliding members 414 are slidable in a horizontal direction. They can be slid by a motor or manually. The sliding member 44 may be supported by walls and/or a raised spot 450 in one end of the filter. The number of the sliding members is the same as the number of the lines where the resonators 408 are aligned. For example, the filter shown in FIG. 4 has 2 lines of the resonators 408 with 4 resonators in each of the lines; it has 2 lines of the sliding members 414.

Metal tuning elements 430 are attached to each of the sliding members 414 at or near the positions in which the resonators 408 are provided. As shown in FIG. 4, for example, 4 metal tuning elements 430 are attached to each of the sliding members 414 and the space intervals between the tuning elements 430 are identical or substantially identical with those between the resonators 408.

As discussed above, sliding members 414 to which the metal tuning elements 430 are attached can be used for tuning of the filter, which makes it possible for the tuning to be made in a simple and rapid way.

As the metal tuning elements 430 are attached to the sliding members 414, the locations of the metal tuning elements 430 may vary in accordance with movement of the sliding members 414. Capacitance is formed by an interaction between the resonators and the metal tuning elements and capacitance thus varies by the change of location of the metal tuning elements. That is, tuning is made by sliding the sliding members.

In case of the filters including a plurality of the sliding members, each of the sliding members may slide independently or the sliding members may slide together. When the plurality of the sliding members slide together, tuning can be at one time. Although the sliding members slide independently, tuning efficiency greatly increases compared with the conventional art.

Figure 5:
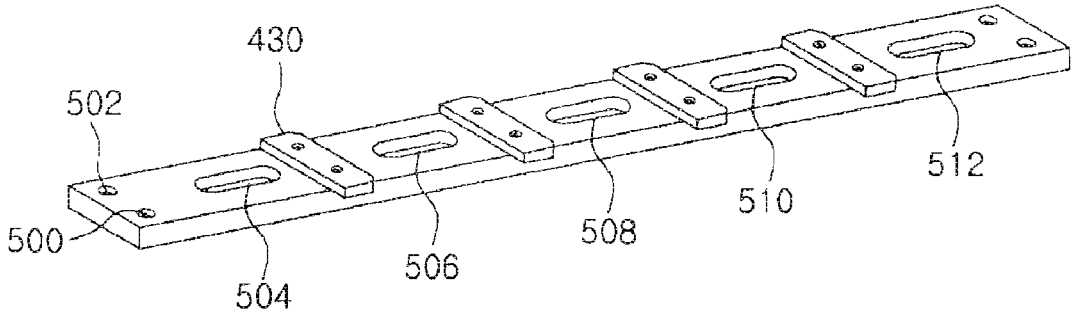
FIG. 5 is a perspective view of a sliding member according to an embodiment of the present invention.
Figure 6:
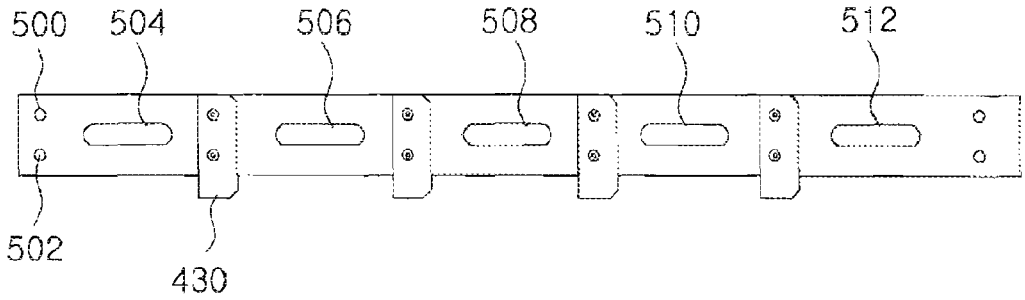
FIG. 6 is a bottom view of the sliding member of FIG. 5.
Figure 7:
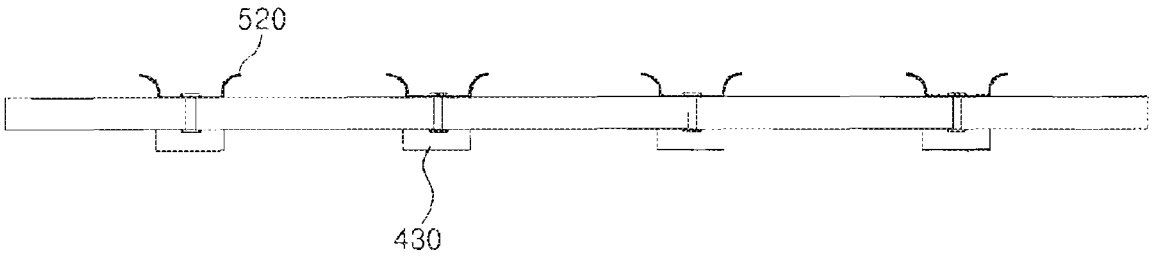
FIG. 7 is a cross sectional view of the sliding member of FIG. 5 with ground members attached.
Figure 8:
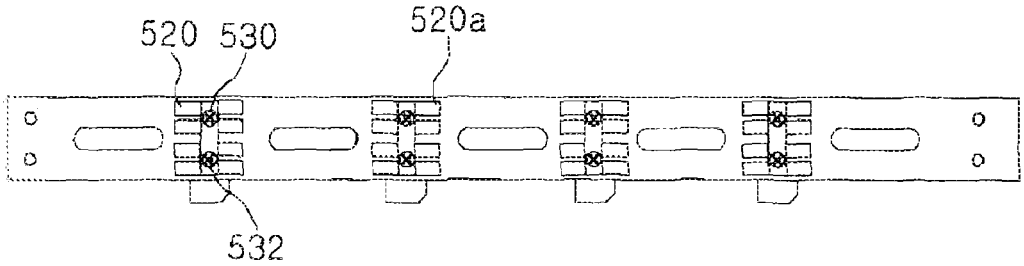
FIG. 8 is a top view of the sliding member of FIG. 7.

FIG. 5 is a perspective view of a sliding member according to an embodiment of the present invention, FIG. 6 is a bottom view of the sliding member of FIG. 5, FIG. 7 is a cross sectional view of the sliding member of FIG. 5 with ground members attached, FIG. 8 is a top view of the sliding member of FIG. 7.

As shown in FIG. 5 to FIG. 8, the metal tuning elements 430 are attached to the sliding member with a predetermined interval therebetween. The interval may be realized so as to correspond to the interval between the resonators 408. That is, the metal tuning elements 430 can be spaced apart from each other in a uniform interval or different intervals depending on the location of the resonators.

Capacitance is determined by the distance and overlapped area between the resonators 408 and the metal tuning elements 430. In the present invention, as the metal tuning elements 430 slide along with the sliding member 414, the distance and overlapped area varies according to the sliding of the sliding member 414, which results in variation of capacitance.

Referring to FIG. 6, the metal tuning elements 430 are in rectangular shape with two edges cut. The shape of the metal tuning elements 430 is not limited to that shown in FIG. 6, and various shapes including circular shape also can be used.

It is preferable that the width of the metal tuning elements is greater than that of the sliding members so that overlapped area between the resonators and the metal tuning elements be larger.

At least one combination holes may be provided on at least one end of the respective sliding members. For example, as shown in FIG. 6, two combination holes 500, 502 are provided. The combination holes 500, 502 are provided for combining the sliding member with a motor operation part for providing power to slid the sliding member, as detailed below.

Preferably, screw thread is formed in each of the combination holes 500, 502 and the sliding member and the motor operation part can be combined using bolts.

In an embodiment, the combination holes 500, 502 are formed only one end of the sliding member. In this case, the other end of the sliding member may be placed a structure that can make the sliding member slide freely. For example, a raised spot may be formed on an end of the filter and the other end of the sliding member can be placed on the raised spot.

The sliding member 414 is provided with a plurality of long holes 504, 506, 508, 510, 512. The long holes are formed to ensure that tuning by the tuning bolts and tubing by the sliding members can be performed without interference with each other. That is, without the long holes, the tuning bolts can prevent the sliding member 414 from being freely slid and the tuning bolts cannot be inserted into the filter because they are blocked by the sliding member. The length and width of the long holes may be adjusted so as to ensure the sliding of the sliding member.

The long holes 504, 506, 508, 510, 512 are provided at or near positions where the tuning bolts are provided. As the interval between the tuning bolts corresponds to that between the resonators, the interval between the long holes corresponds to that between the resonators and that between the metal tuning elements 430. Of course, the interval between the long holes may be different from that between the resonator and/or that between the metal tuning elements.

Referring to FIG. 7, a plurality of ground members 520 each are attached to an upper part of the sliding member 414. Preferably, the number of the ground members is the same as that of the metal tuning elements. The location of the ground members also corresponds to that of the metal tuning elements. In this regard, preferably, while the ground members 520 are attached to the upper part of the sliding member 414, the metal tuning elements 430 are attached to the opposite part of the sliding member 414.

The ground members 520 are electrically coupled to the metal tuning elements 430 and provide ground voltage to the metal tuning elements 430. The ground members 520 are also electrically coupled to the cover that is electrically ground, and therefore, the metal tuning elements 430 can maintain ground voltage.

According to an embodiment of the present invention, the ground members 520 and the metal tuning elements 430 are electrically coupled by bolts. Referring to FIG. 7 and FIG. 8, the sliding member is provided with a hole through which a bolt can be inserted. Each of the ground members 520 and each of the metal tuning elements 430 are combined with at least one bolt inserted to the hole. For example, as shown in FIG. 8, each of the ground members 520 and each of the metal tuning elements 430 can be coupled by two bolts 530, 532.

If the interval or intervals between the metal tuning elements 430 are long and more stable grounding is required, more number of the ground members can be attached to the upper part of the sliding member without regard to the number of the metal tuning elements.

In principle, as discussed above, capacitance is determined by an area, a distance and a dielectricity. In the present invention, the area and distance vary.

According to the embodiment of the present invention, the ground members 520 are located in one side of the sliding member 414 and the metal tuning elements 430 are located in the opposite side thereof and the ground members 520 and the metal tuning elements 430 are electrically coupled in order to provide ground voltage. Therefore, stable variation of capacitance is possible although metal is used as the tuning element.

As described above, the ground members 520 are in contact with the cover, which may affect the sliding operation of the sliding members on account of friction. According to an embodiment of the present invention, a structure for minimizing and/or eliminating the friction is provided. In particular, referring to FIG. 8, the ground members 520 may have a plurality of wings 520*a* having elasticity. A preferable example of the wings is leaf springs. The wings 520*a* are in electrical contact with the lower part of the cover, and the contact is maintained stably because the wings 520*a* have elasticity. Although FIG. 8 shows that 8 wings are formed on each of the ground members, the size as well as the number of the wings may vary in accordance with filter structure.

Figure 9:
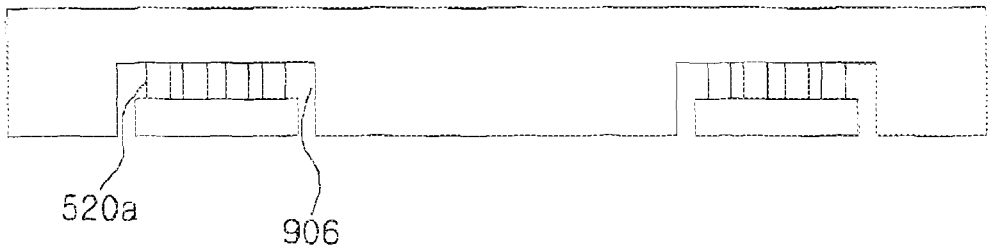
FIG. 9 and FIG. 10 show a cover in contact with ground members according to a preferred embodiment of the present invention.
Figure 10:
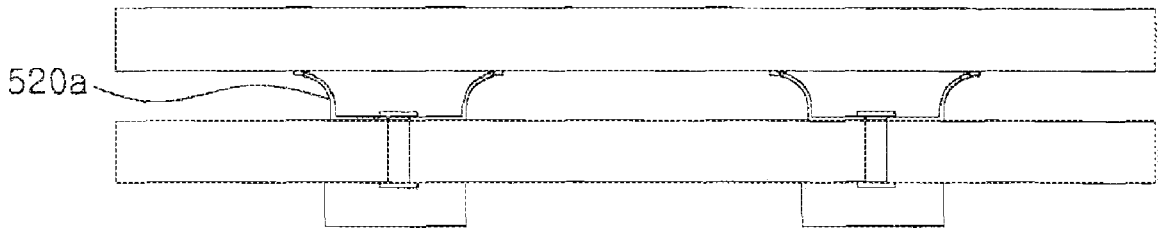

FIG. 9 and FIG. 10 show a cover being in contact with ground members according to a preferred embodiment of the present invention. End point of the wings 520*a* having elasticity is contacted with a lower part of the cover. As the end point of the wings has a relatively small size, friction can be minimized and/or eliminated when the sliding member slides. Further, as the wings 520*a* have elasticity, stable contact can be maintained although the contact area is small.

The cover is provided with at least one guide groove 906 in a lower part thereof for guiding sliding operation of a sliding member inserted in the guide groove 906. In case of the filters including a plurality of sliding members, a plurality of guide grooves are formed. A separate guiding means can be provided in addition to or without the groove. It should be noted that any type of guiding means known to those skilled in the art can be used.

Figure 11:
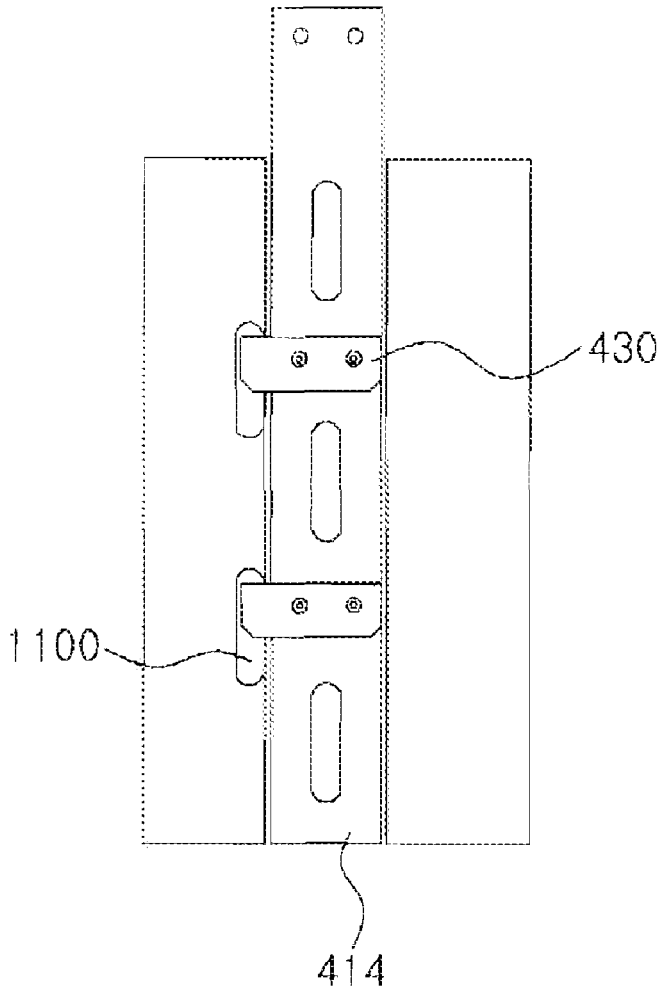
FIG. 11 show a sliding member inserted in a guide groove according to an embodiment of the present invention.

FIG. 11 shows a sliding member inserted in a guide groove according to an embodiment of the present invention. As shown in FIG. 11, the width of the guide groove 906 is greater than that of the sliding member 414. The depth of the guide groove 900 may be greater than or the same as the thickness of the sliding member 414. Alternatively, the depth of the guide groove 906 may be smaller than the thickness of the sliding member 414, in which case a part of the thickness of the sliding member 414 is inserted in the guide groove 906.

In case of the filters including a plurality of sliding members, a plurality of the guide grooves may be formed.

As described above, as the width of the metal tuning elements 430 is greater than that of the sliding members 414, friction between the metal tuning elements and the lower part of the cover may occur. In an embodiment of the present invention, a structure for minimizing and/or eliminating the friction is provided. In particular, shallow friction prevention grooves 1100 are formed on the lower part of the cover. It is preferable that the friction prevention grooves 1100 are as shallow as possible. Further, the length of the friction prevention grooves corresponds to sliding range of the metal tuning elements 430, as illustrated in FIG. 11.

Figure 12:
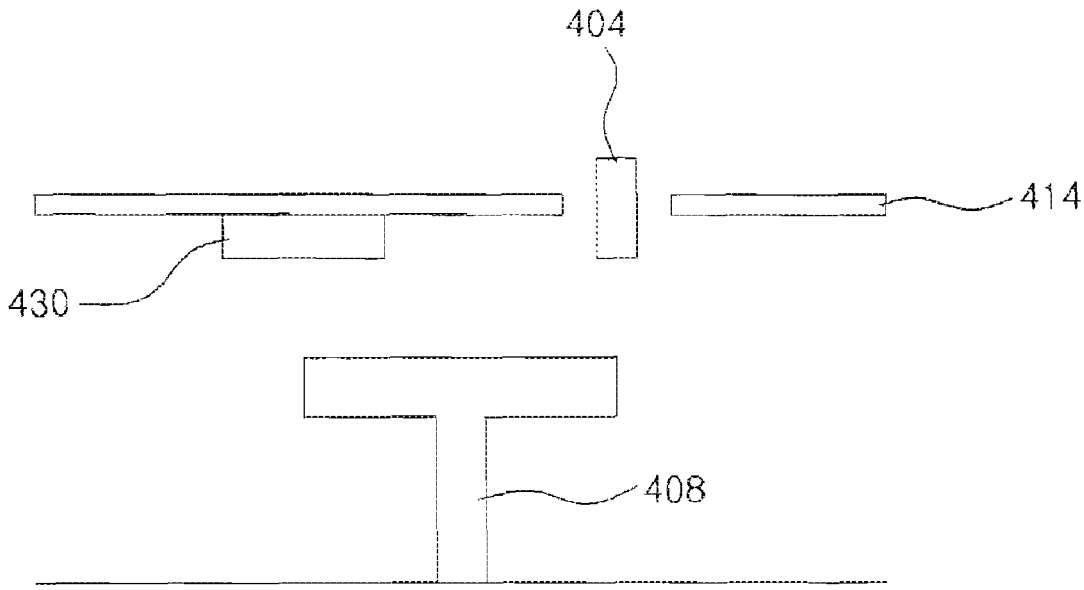
FIG. 12 is a cross sectional view of a cavity of the filter according to a preferred embodiment of the present invention.

FIG. 12 is a cross sectional view of a cavity of the filter according to a preferred embodiment of the present invention. In the cavity, one resonator 408 is installed. The resonator 408 is fixed on the bottom of the filter by a bolt. Although a disk type resonator is shown in FIG. 12, various types of resonators can be used.

Over the resonator 408 lies the sliding member 414. The tuning bolt 404 is inserted through the long hole of the sliding member 414. Generally, the tuning bolt 404 is located over the center of the resonator 408. However, as shown in FIG. 12, the tuning bolt 404 can be located at a position that is a little shifted from the center of the resonator in consideration of sliding range of the metal tuning element 430 with respect to the resonator 408. More specifically, if the tuning bolt 404 is placed over the center of the resonator 408, the tuning bolt 404 can block sliding of the sliding member 414 so that the metal tuning element 430 may not be positioned over the center of the resonator 408.

In an embodiment, tuning may be performed only with the sliding members 414. In this case, the tuning bolts 404 may be or may not be included in the filter. When the tuning bolts 404 are included, they may be mainly used in initial tuning.

As discussed above, capacitance is determined by the distance between the resonators 408 and the metal tuning elements 430 and overlapped area of the metal tuning elements 430 and the resonators 408. In FIG. 12, when the sliding member 414 slides to right direction, the overlapped area between the metal tuning element 430 and the resonator 408 becomes larger, which results in increase of capacitance.

Figure 13:
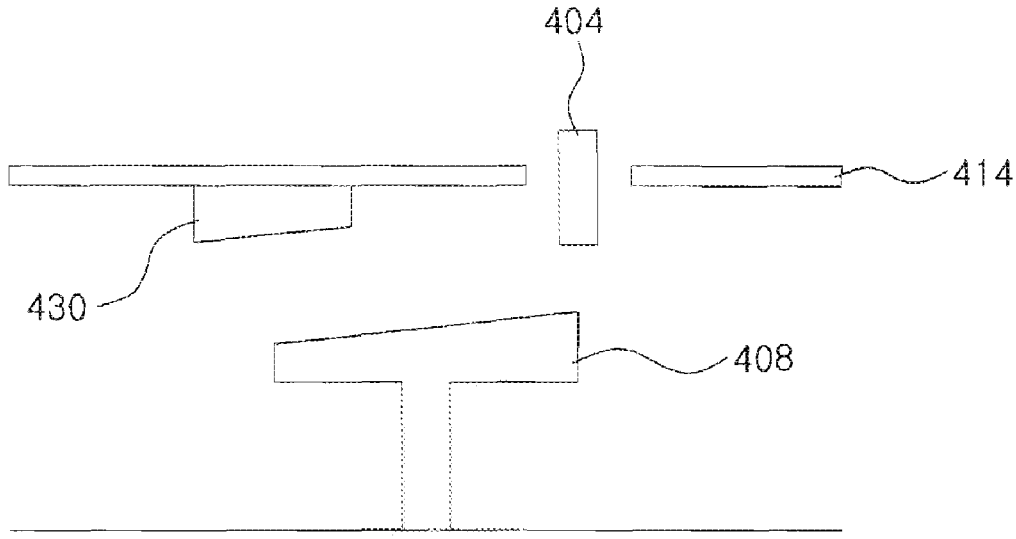
FIG. 13 is a cross sectional view of a cavity of the filter according to another embodiment of the present invention.

FIG. 13 is a cross sectional view of a cavity of the filter according to another embodiment of the present invention. Unlike the metal tuning elements shown in FIG. 4 to FIG. 12, the metal tuning element 430 of shown in FIG. 13 has a slope formed on the lower surface thereof. Further, the resonator 408 has a slope formed on the upper surface thereof. The slopes may be formed in the same direction or different directions. For example, slope of the metal tuning element 430 may fall from left to right, while slope of the resonator 408 rises from left to right. Also, slope angles of the metal tuning element 430 and the resonator 408 may be identical or different. Further, slope may be formed on only one of the metal tuning element 430 and the resonator 408.

In the conventional filter in which tuning is made by rotating tuning bolts, tuning range is set by the distance between the tuning bolts and the resonators. Moreover, in case of the filter having a low height, tuning range is limited.

In the filter according to the embodiment of the present invention, wider tuning range can be obtained compared with the conventional filter by the slope provided on the metal tuning element 430 and/or the resonator 408.

In order to obtain wider tuning range, variation amount of capacitance needs to be larger. If the slope is formed on the metal tuning element 430 and the resonator 408, the distance as well as overlapped area therebetween varies more greatly, which results in larger variation of capacitance.

Figure 14:
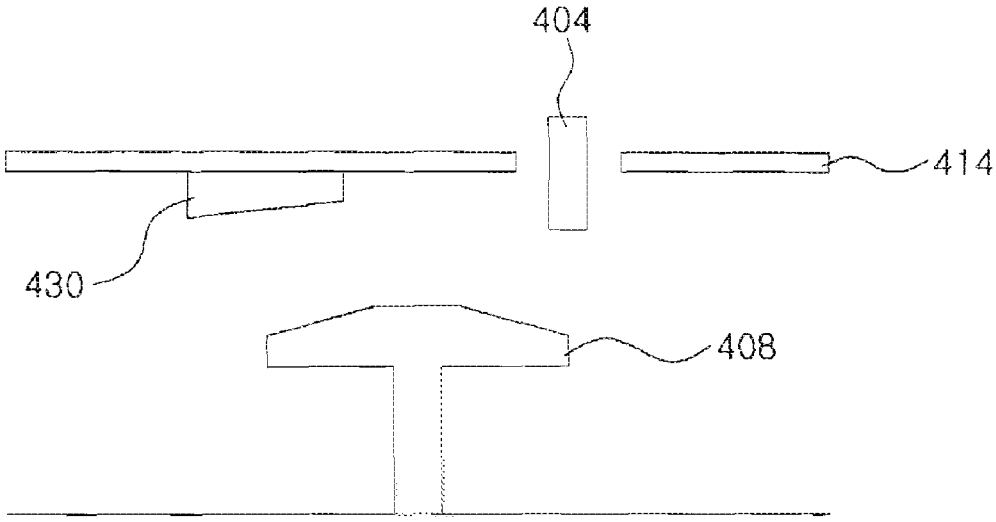
FIG. 14 is a cross sectional view a cavity of the filter according to still another embodiment of the present invention.

FIG. 14 is a cross sectional view of a cavity of the filter according to still another embodiment of the present invention. Referring to FIG. 14, a truncated cone is formed on the upper surface of the resonator 408. If the truncated cone is formed on the upper surface of the resonator, manufacturing cost can be reduced because it is easier to form upper surface slope in the form of truncated cone. The filter having the cavity structure shown in FIG. 14, like the filter having the cavity structure shown in FIG. 13, has increased tuning range. It should be noted that various modifications of the filter of FIG. 13 and FIG. 14 are within the scope of the present invention.

Figure 15:
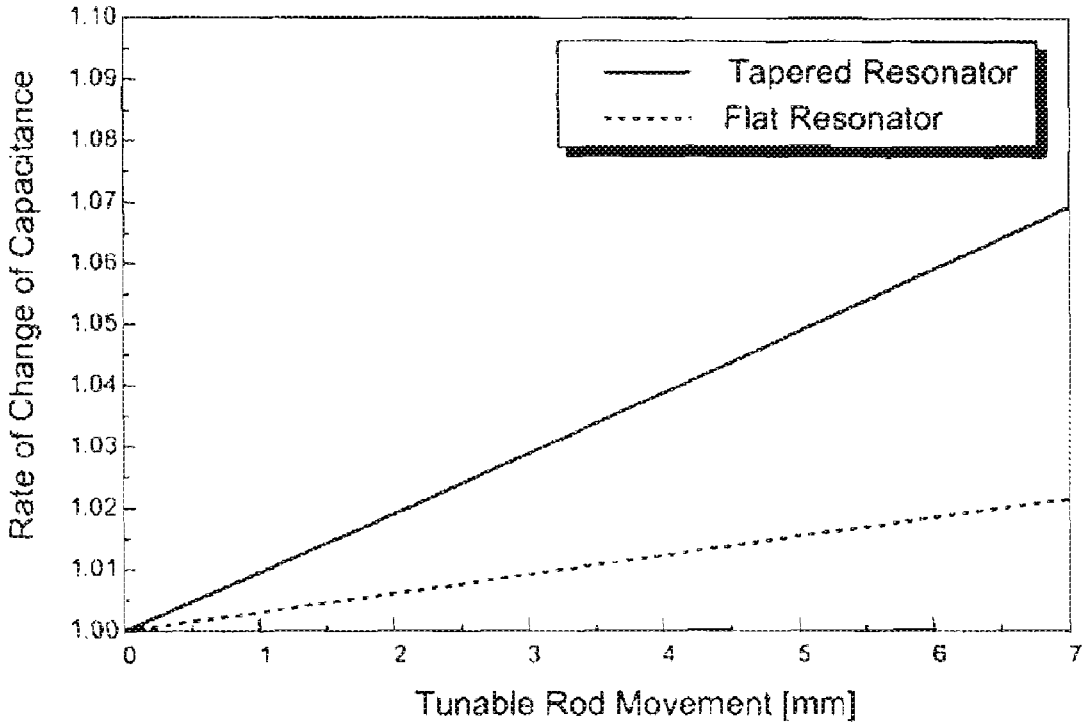
FIG. 15 is a graph showing difference in the rate of capacity change when flat metal tuning element and flat resonator are used and when tapered metal tuning element and tapered resonator are used.
Figure 16:
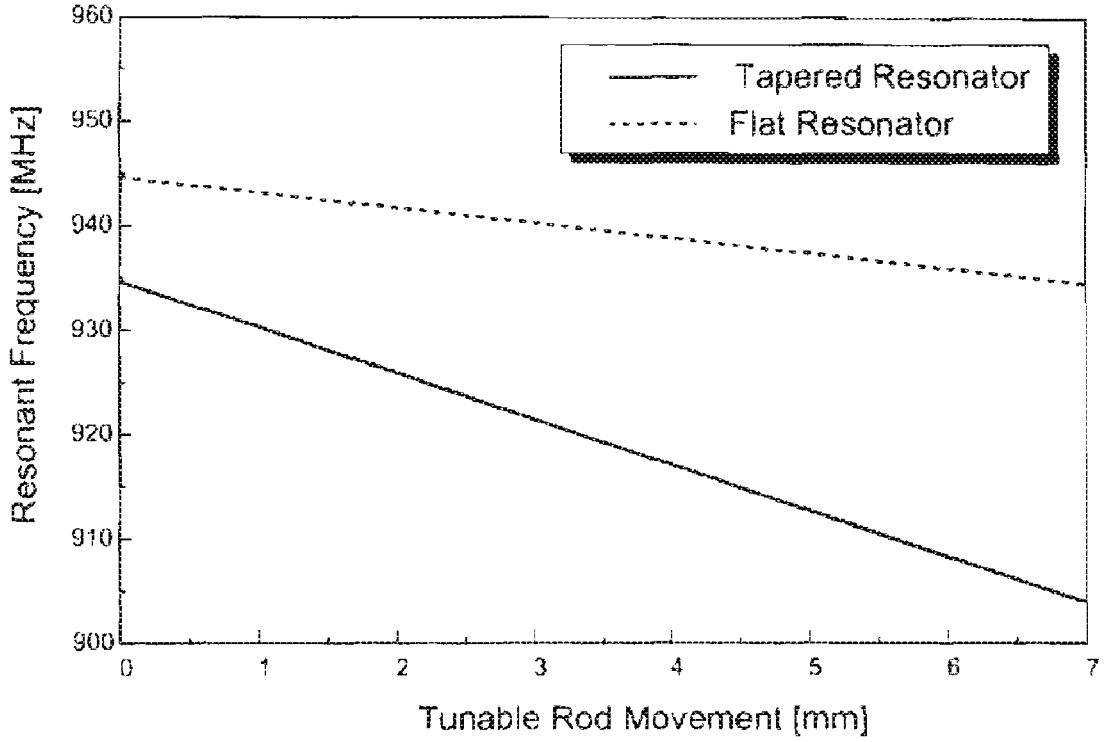
FIG. 16 is a graph showing difference in the resonant frequency change when flat metal tuning element and flat resonator are used and when tapered metal tuning element and tapered resonator are used.

FIG. 15 is a graph showing difference in the rate of capacity change when flat metal tuning element and flat resonator are used and when tapered metal tuning element and tapered resonator are used. FIG. 16 is a graph showing difference in the resonant frequency change when flat metal tuning element and flat resonator are used and when tapered metal tuning element and tapered resonator are used. Both the rate of capacity change and resonant frequency change are larger when tapered tuning element and resonator are used.

Figure 17:
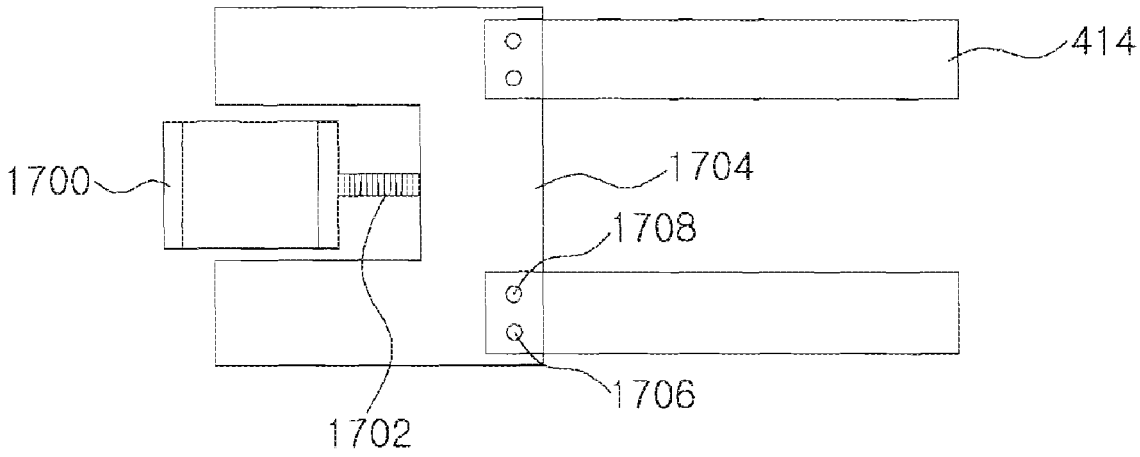
FIG. 17 and FIG. 18 show a coupling structure of a sliding member and a motor operation part for sliding the sliding member according to a preferred embodiment of the present invention.
Figure 18:
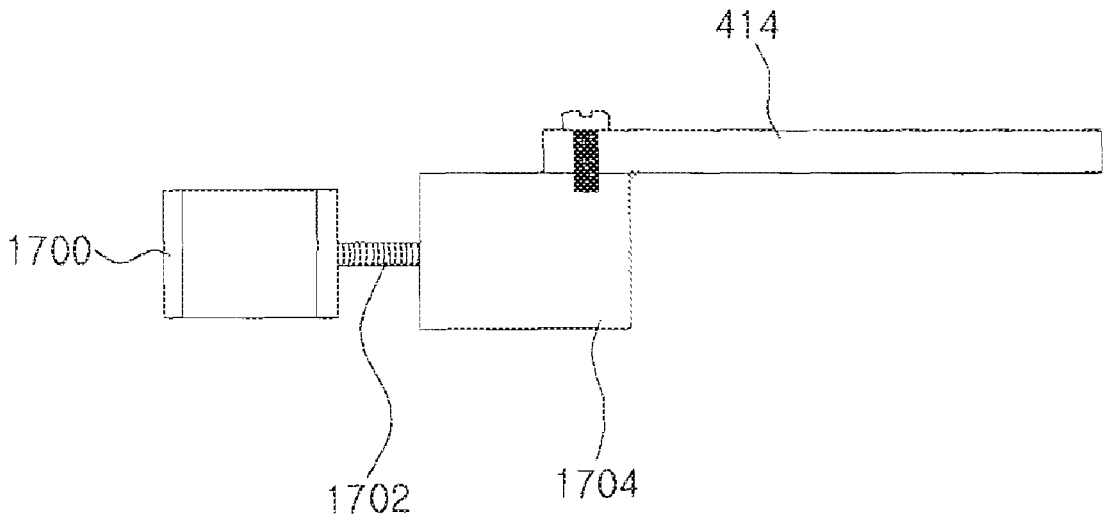

FIG. 17 and FIG. 18 show a coupling structure of a sliding member and a motor operation part for sliding the sliding member according to a preferred embodiment of the present invention. Referring to FIG. 17, the motor operation part comprises a motor 1700, a screw 1702 coupled to the motor 1700 and a middle member 1704.

The motor 1700 provides rotation power and the rotation power is transferred to the screw 1702. The screw 1702 transforms rotation movement into horizontal movement. On upper surface of the middle member 1704 are formed combination holes 1706, 1708. The combination holes 1706, 1708 of the middle member 1704 correspond to the combination holes 500, 502 of the sliding member 414, respectively. Like the combination holes 500, 502, the combination holes 1706, 1708 have screw thread therein. The sliding member 414 and the middle member 1704 are combined using a bolt inserted into the holes. Of course, various combining mechanism other than the screw thread and bolt can be used.

The motor operating part can be provided at least one ends of the sliding members 414. In an embodiment, while one end of the sliding member 414 is combined with the middle member 1704, the other end of the sliding member 414 is not fixed for free sliding. For example, as shown in FIG. 4, the other end of the sliding member may lie on the raised spot 450 formed in the filter. In this case, the raised spot is preferred to be wide enough considering sliding range of the sliding member 414.

Also, the motor operation part may be provided inside the filter, outside the filter, or both. When the motor operation part is located outside the filter, a portion of the sliding member is projected from the filter to be coupled with the motor operation part.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

The invention claimed is:

1. A frequency tunable filter, comprising:

a housing having a plurality of cavities defined by a plurality of walls;

a cover mounted on the housing;

a plurality of tuning bolts inserted into the cover;

a plurality of resonators contained in the cavities;

at least one sliding member located between the cover and the plurality of resonators; and a plurality of metal tuning elements attached to a lower part of the sliding member, wherein frequency tuning is performed by sliding the at least one sliding member, and wherein holes are formed in the at least one sliding member for insertion of the plurality of tuning bolts and the holes are elongated as to not block the sliding of the at least one sliding member.

2. A frequency tunable filter using sliding of a sliding member, comprising:

a plurality of resonators contained in a plurality of cavities;

a plurality of metal tuning elements attached to the sliding member, the plurality of metal tuning elements being associated with resonators and being located over the plurality of resonators; and a plurality of ground members for providing ground voltage to each of the plurality of metal tuning elements respectively, the plurality of ground members being electrically coupled to the metal tuning elements respectively, wherein the plurality of ground members include wings for contacting the cover respectively, the wings having an elastic body, wherein a guide groove is formed on the cover for guiding the sliding member, the sliding member is inserted into the guide groove, and the wings are electrically coupled to the guide groove of the cover, and wherein a plurality of friction prevention grooves are formed in the cover beside the guide groove corresponding to the plurality of metal tuning elements in order to prevent friction between the plurality of metal tuning elements and the cover.

3. The frequency tunable filter of claim 2, wherein the plurality of ground members are attached to an upper part of the sliding member.

4. The frequency tunable filter of claim 3, wherein the plurality of ground members are attached to the sliding member opposite the plurality of metal tuning elements, and the plurality of ground members are electrically coupled to a cover of the frequency tunable filter.

5. The frequency tunable filter of claim 4, wherein a number of the plurality of metal tuning elements corresponds to a number of the plurality of resonators and a number of the plurality of ground members corresponds to a number of the plurality of metal tuning elements.

6. The frequency tunable filter of claim 5, wherein the plurality of ground members are coupled to the sliding member and the plurality of metal tuning elements through a corresponding bolt of a plurality of bolts.

7. The frequency tunable filter of claim 2, wherein the elastic body, includes a leaf spring.

* * * * *